United States Patent [19]

Morita

[11] Patent Number: 5,060,931

[45] Date of Patent: Oct. 29, 1991

[54] DRUM FOR IMAGE RECORDING APPARATUS

[75] Inventor: Naoyuki Morita, Kanagawa, Japan

[73] Assignee: Fuji Photo Film Co., Ltd., Kanagawa, Japan

[21] Appl. No.: 396,207

[22] Filed: Aug. 21, 1989

[30] Foreign Application Priority Data

| | | | |
|---|---|---|---|
| Aug. 22, 1988 | [JP] | Japan | 63-207848 |
| Aug. 23, 1988 | [JP] | Japan | 63-209095 |
| Aug. 23, 1988 | [JP] | Japan | 63-209096 |

[51] Int. Cl.[5] ..... B65H 5/06

[52] U.S. Cl. ..... 271/276; 271/196

[58] Field of Search ..... 271/5, 94, 95, 105, 271/112, 194, 196, 276, 90

[56] References Cited

U.S. PATENT DOCUMENTS

| | | | |
|---|---|---|---|
| 3,227,441 | 1/1966 | Fraidenburgh et al. | 271/5 |
| 3,271,024 | 9/1966 | May | 271/94 |
| 3,464,129 | 9/1969 | Mitchell | 271/94 X |
| 4,184,670 | 1/1980 | Rosendahl | 271/94 X |
| 4,403,847 | 9/1983 | Chrestensen | 271/196 X |
| 4,437,659 | 3/1984 | Caron et al. | 271/196 X |
| 4,660,825 | 4/1987 | Umezawa | 271/5 X |
| 4,792,249 | 12/1988 | Lahr | 271/276 |

FOREIGN PATENT DOCUMENTS

| | | | |
|---|---|---|---|
| 62-21476 | 9/1987 | Japan . | |
| 13358 | 1/1989 | Japan | 271/196 |
| 364847 | 1/1932 | United Kingdom | 271/194 |
| 730100 | 5/1955 | United Kingdom | 271/94 |
| 2084965 | 4/1982 | United Kingdom | 271/94 |

*Primary Examiner*—Robert P. Olszewski
*Assistant Examiner*—Boris Milef
*Attorney, Agent, or Firm*—Sughrue, Mion, Zinn, Macpeak & Seas

[57] ABSTRACT

A drum for an image recording apparatus for absorbing and winding a recording material for the purpose of recording the image by an exposure head thereof. The main body of the drum is structured by arranging a plurality of cylindrical members having a relatively smaller axial direction. Since the drum is formed by arranging the cylindrical members, the drum can be readily manufactured. A guide is provided on the outer surface of the drum, this guide guiding, pressing, and retaining the front portion of the recording material to the outer surface of the drum so that the absorption of the recording material is conducted assuredly. The shaft of the drum is borne by a radial ball bearing which has a sealing member so that air leakage when the absorption is conducted is prevented.

8 Claims, 15 Drawing Sheets

DRUM FOR IMAGE RECORDING APPARATUS

BACKGROUND OF THE INVENTION

1. Field of the Invention

The present invention relates to a drum for an image recording apparatus, and more particularly to a drum for an image recording apparatus capable of absorbing an image recording material and winding the thus-absorbed image recording material on the outer surface thereof.

2. Description of the Related Art

In an image scanning and recording apparatus, a recording material is wound to a rotary drum capable of absorbing the recording material and the image is scanned by a relative movement between a recording head disposed to correspond to this rotary drum and the recording material so that the recording material is exposed to light. After the recording material has been exposed to light, it is removed from the rotary drum so as to be sent to the ensuing processes.

As shown in FIGS. 12 and 13, the rotary drum above is structured in such a manner that hollow shafts 172 and 175 are, with side plates 173, secured to the two ends of the cylindrical main body 170 thereof.

As shown in FIG. 14, an wedge shape cutout 176 is formed in a portion of the outer surface of the main body 170. Furthermore, a plurality of absorption holes 174 are formed on the outer surface of the main body 170, this absorption hole 174 being also formed in the cutout 176. A guide plate 178 is so disposed above the cutout 176 so as to cover this cutout 176, this guide plate 178 acting to guide the recording material to the cutout 176.

The shaft 172 for the rotary drum is supported by a housing and is connected to a vacuum source via a connection hole formed in the housing, the shafts 175 being further connected to a power source for the rotation.

The recording material is wound to the outer surface of the drum in such a way that the recording material is supplied along the outer surface of the main body 170, and the front end of the recording material is inserted into a gap formed between the cutout 176 and the guide plate 178. Then, air in the main body 170 is sucked via the shaft 172 so that a negative pressure is generated. As a result, the front end of the recording material is brought into close contact with the absorption holes 174. Furthermore, the recording material is brought into close contact with the outer surface of the drum with the rotary drum rotated by the rotating power.

The rotary drum is, as shown in FIG. 15, manufactured from a plurality of manufacturing processes. That is, the main body 170 is cut from a pipe in a cutting process 180. In a lathe process 182, the two ends of the thus-cut main body 170 are subjected to a fitting work. On the other hand, the side plates 173 and the shaft 172 are manufactured from the raw material in lathe processes 184 and 186, and the thus-manufactured side plates 173 and the shaft 172 are integrated with each other in a press fitting process 188. Then, the side plates 173 to which the shaft 172 has been secured are press-fitted into the main body 170 so that they are integrated with each other before being subjected to cutting in a milling process 192. Then, the absorption holes are formed in the outer surface of the main body in a milling process 194 before being further subjected to a lathe process 196 so that the outer surface is finished so as to become a smooth surface. Then, the guide plate is finally secured as described above.

As described above, since the conventional rotary drum is manufactured from a considerably large number of manufacturing processes, the manufacturing work is too complicated and a long time needs to be taken to complete the manufacturing. Furthermore, the lathe work and the milling need expensive machines, causing the manufacturing cost to become excessively high. Furthermore, each of these multiplicity of manufacturing processes needs to be subjected to a checking for the manufacturing accuracy, causing the necessity of employing skilled workers.

Since the conventional rotary drum is arranged such that the front end of the recording material supplied as described above is guided by the guide plate 178, the thus-guided recording material is simply inserted into the gap formed between the cutout 176 and the guide plate 178. Therefore, the thus-inserted recording material can easily float toward the guide plate 178 due to the rigidity thereof. As a result, if a negative pressure is generated by sucking air, the front end of the recording material cannot be assuredly brought into contact with the absorption holes 174. In particular, if the front end of the recording material has curl or turn, the problem of the type described above becomes excessively apparent.

Furthermore, if the recording material is inserted by an excessive length into the gap formed between the cutout 176 and the guide plate 178, sucked air leakage can be generated due to the buckling of the front end of the recording material in this gap.

As a result, the performance of absorbing the recording material deteriorates, causing a problem in that the recording material cannot be assuredly wound to the rotary drum to arise.

In order to overcome the above-described problems, it needs to take countermeasures against them in such a way that the shape of cutting the front end of the recording material and the positioning of the same are made properly or that the feeding control of the front end of the recording material can be conducted precisely. In addition, all of the above-described method arise the cost excessively.

Furthermore, since air is sucked via the shaft 172 in the conventional rotary drum, the portions bearing the rotation of the shaft 172, that is, the space between the outer surfaces of the rotating shaft 172 and the housing necessarily encounters a problem of sucked air leakage. Therefore, a problem arises in that the recording material cannot be brought into assuredly contact with the outer surface of the main body 170 or another problem arises in that the necessary power for operating the negative pressure source cannot be reduced.

In order to overcome the above-described problems, the applicant of the present invention has disclosed an art established for the purpose of preventing sucked air leakage by a so-called "labyrinth effect" generated due to an extremely narrow slit (several tens of microns) formed between the outer surface of the shaft 172 and the housing for a distance of several tens of millimeters (Japanese Patent Laid-Open No. 62-214768).

According to this disclosure, the small gap formed between the outer surfaces of shaft 172 and the housing can generate an effect similar to the labyrinth effect so that any sucked air leakage through the portions bearing the rotation of the shaft 172 can be prevented. In addition, since the outer surface of the shaft 172 cannot be brought into contact with the housing, the frictional resistance in this area can be reduced, and the power needed to operate the rotating power source can be reduced.

However, the gap formed between the outer surface of the shaft 172 and the housing is extremely small (substantially several tens of microns) and this gap is positioned in a considerably wide region in the bearing structure for the shaft 172, an extreme accurate machining needs to be conducted to manufacture the shaft 172 and the housing. Therefore, the manufacturing yield is insufficient and the cost becomes excessively high. Furthermore, a complicated adjustment needs to be conducted when the above-described two types of components are assembled to each other. In addition, if a slight warp of the shaft 172 due to an impact is generated, an operative malfunction can occur due to the interference with the housing. Therefore, it is necessary to pay attention during handling the above described structure and during usage.

To this end, an object of the present invention is to provide a rotary drum capable of being manufactured from simple and reduced number of manufacturing processes with its cost reduced.

Another object of the present invention is to provide a rotary drum in which a recording material can be assuredly and stably absorbed and wound to the outer surface thereof with its cost reduced.

Another object of the present invention is to provide a sheet absorption drum in which any sucked air leakage can be prevented when internal air is sucked via shaft which is rotatably supported with a simple structure, causing the manufacturing yield to become significantly high, and causing the required cost to be reduced.

SUMMARY OF THE INVENTION

In order to achieve the above-described objects, a drum for an image recording apparatus according to the present invention comprises:

a main body member structured by arranging a plurality of cylindrical members in the axial direction and in which a plurality of openings for absorbing a recording material are formed in the surface wall thereof;

a pair of side members for closing the two sides of the main body and forming a chamber in association with the surface wall; and a shaft member so arranged as to penetrate the main body and the pair of side members, and as to be secured to at least the pair of side members, in which a through hole establishing a connection between the chamber and outside is formed therein.

According to the drum structured as described above, the shaft is inserted into a pair of side members, and the plurality of cylindrical members are connected to one another between the side members so that a cylindrical drum is formed.

In this case, since a pair of the side members and a plurality of the cylindrical members can comprise molded products or cast products which can be molded to have a predetermined shape only in a manufacturing process. Furthermore, when the thus-produced components are assembled to form the rotary drum, it can be formed simply by connecting the shaft inserted into a pair of the side members and a plurality of the cylindrical members to one another between the above-described side members before a sub-machining such as grinding the outer surface of the thus-formed drum.

Therefore, the manufacturing process can be significantly reduced with respect to that needed to form the conventional rotary drum without necessity of using expensive machines, causing the required cost to be reduced. Furthermore, since the rotary drum according to the present invention can be manufactured by molding or casting, an improved freedom in designing the shape can be exhibited.

As described above, the drum according to the present invention can be manufactured in a simple and reduced manufacturing processes, so that the cost can be reduced, and an improved freedom in designing the shape can be exhibited. As a result, a design in which the inertia force is intended to be reduced or a design in which the correction of dynamic balance is intended to be corrected can be readily conducted.

A drum for an image recording apparatus according to the present invention comprises:

a cylindrical main body in which a plurality of openings for absorbing a recording material to the surface thereof are formed therein;

a pair of side members for closing the two ends of the main body and forming a chamber in association with the surface;

a shaft member having a first shaft secured to either side of the side member and a second shaft secured to another side of the side member and in which a through hole connecting the chamber with outside is formed; and means for guiding the front portion of the recording material to be wound to the outer surface of the main body and pressing and retaining the same to the outer surface of the main body.

According to the drum for the image recording apparatus, the supplied recording material is guided to the outer surface of the main body, and the front end thereof is retained with pressed and made in contact with this outer surface. Therefore, any leakage can be prevented when a negative pressure is generated by sucking air for the purpose of absorbing the front end of the recording material through the opening. As a result, it can be assuredly and stably absorbed and wound to the outer surface of the drum.

The drum for the image recording apparatus according to the present invention can be rotatably borne by a radial ball bearing having a sealing member secured to either the inner surface of the outer race or the outer surface of the inner race, this sealing member being closed in the circumferential direction of the drum.

According to the drum structured as described above, the shaft thereof is borne by a radial roller-bearing so that the same can be rotated axially.

An end of the seal lip is secured to the both ends of either the outer race or the inner race of the radial roller-bearing so that the space between the inner race and the outer race is sealed with this seal lip. As a result, if air is sucked with the shaft secured to the inner race rotated, leakage of the thus-sucked air through the portion at which the outer surface of the shaft is borne can be prevented. As a result, a drum for an image recording apparatus exhibiting the similar absorbing performance to that displayed by a drum in which a labyrinth seal is employed can be obtained.

Therefore, according to the present invention, effects in that any leakage of sucked air can be prevented when air in the main body is absorbed and this effect can be realized by a simple structure and the cost thereof can, thereby, be reduced.

DESCRIPTION OF THE PREFERRED EMBODIMENTS

Figure 1:
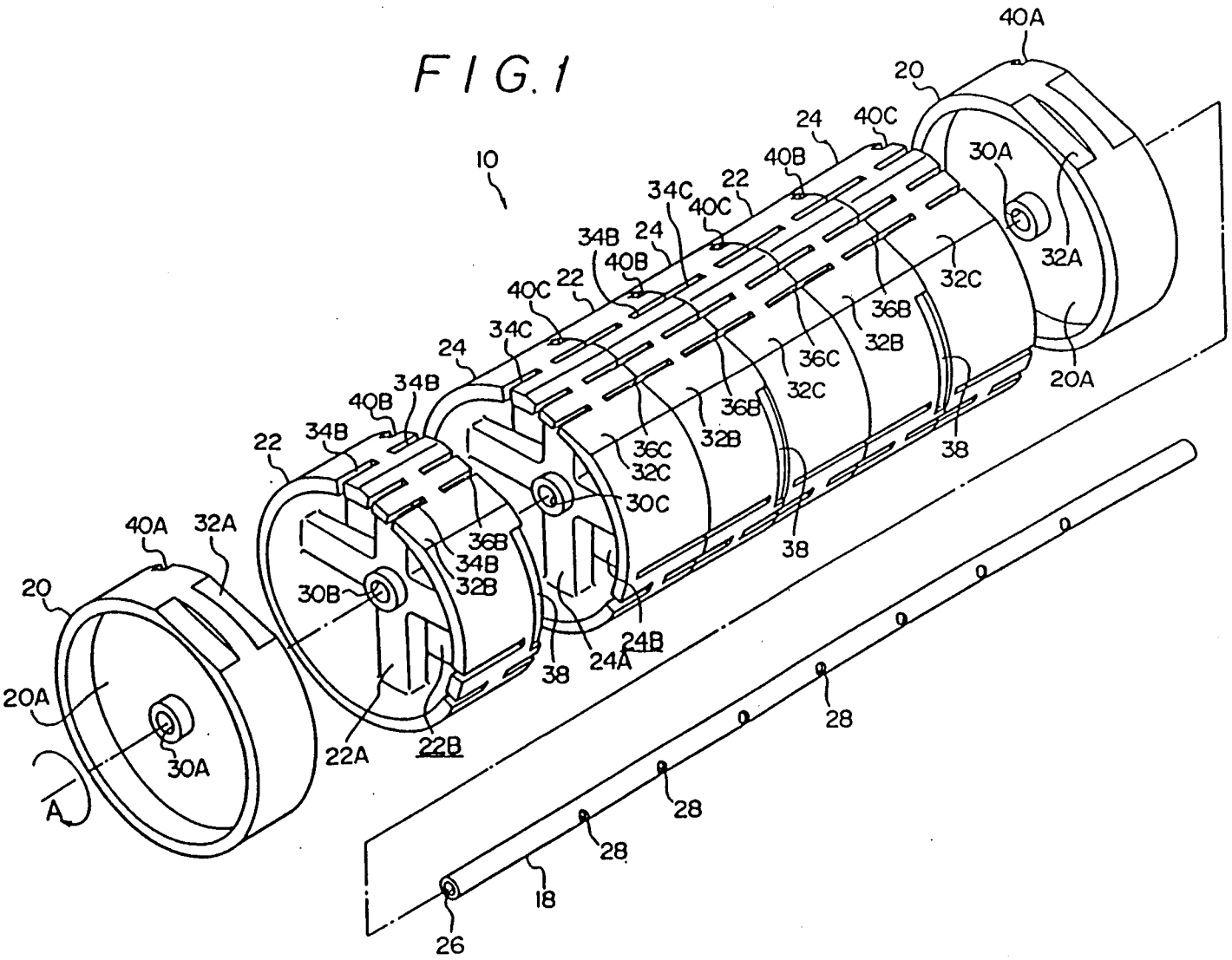
FIG. 1 is an exploded perspective view which illustrates a first embodiment of a rotary drum according to the present invention.
Figure 4:
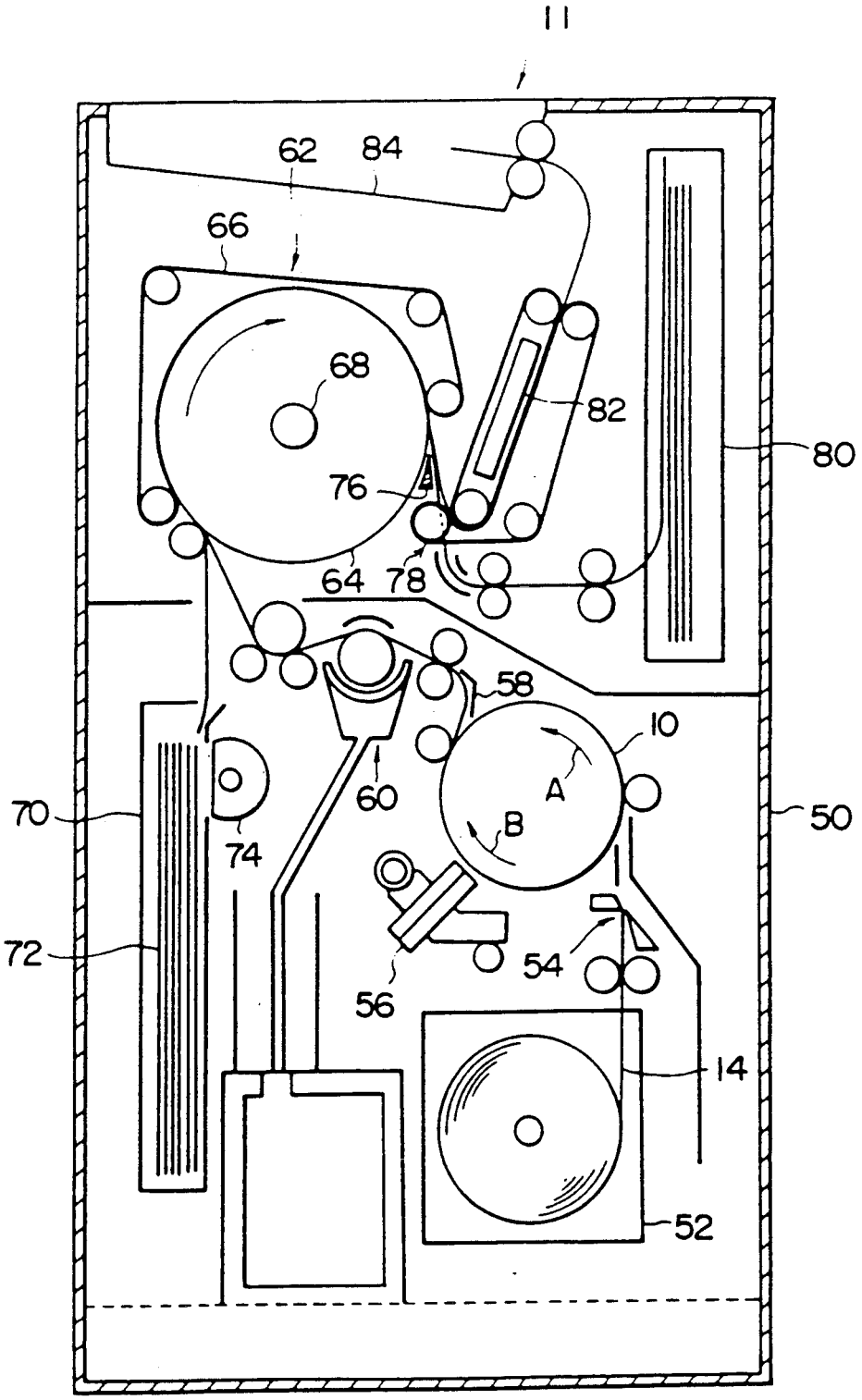
FIG. 4 is a schematic cross-sectional view which illustrates an image scanning and recording apparatus to which the rotary drum is employed.

FIG. 1 is an exploded perspective view which illustrates a first embodiment of a rotary drum 10 according to the present invention. FIG. 2 is a cross-sectional view which illustrates the rotary drum 10. FIG. 4 is a view which illustrates an image scanning and recording apparatus 11 in which the rotary drum 10 is employed. A guide plate is omitted from illustration.

As shown in FIG. 4, a magazine 52 to be accommodated in a frame 50 of the image scanning and recording apparatus 11 accommodates a photosensitive material 14 to be thermally developed and serving as a roll type image forming sheet. The thermal development photosensitive material 14 is rolled out from the outside thereof so as to be cut into a predetermined length with a cutter 54. Then, the thus-obtained thermal development photosensitive material 14 of a predetermined length is arranged to be, by a guide roller, wound to the outer surface of the rotary drum 10 which rotates in a direction designated by an arrow A.

An exposure head 56 is disposed in the portion adjacent to the outer surface of the rotary drum 10 in the axial direction of the rotary drum 10 (in the perpendicular direction to the drawing sheet for FIG. 4) so as to correspond to this outer surface.

The exposure head 56 repeats its movement in the axial direction of the rotary drum 10 with performing its main scanning action by means of the high speed rotation of the rotary drum 10 in the direction designated by the arrow A so that an image is exposed to the photosensitive material 14 to be thermally developed and wound to the rotary drum 10 to be thermally developed.

After the exposure process, the thermal development photosensitive material 14 is scraped from the rotary drum 10 by a scraper 58 due to the reverse rotation of the rotary drum 10 (in the direction designated by an arrow B). Then, the thus-scraped thermal development photosensitive material 14 is subjected to water serving as a solvent for forming the image in the water applying portion 60 before being sent to a thermally developing and transferring portion 62 whose inner portion is arranged to be a heating portion.

The thermally developing and transferring portion 62 comprises a heating drum 64 and an endless pressing belt 66. A halogen lamp 68 is disposed in the heating drum 64 so that the outer surface of the heating drum 64 is heated up to substantially 90° C.

On the other hand, a plurality of image receiving materials 72 each of the length of which is cut to a predetermined length is accommodated in a tray 70 disposed below the thermally developing and transferring portion 62. These image receiving materials 72 are arranged to be successively taken out by a supply roller 74 disposed on the side portion so as to be conveyed to the thermally developing and transferring portion 62 with being laminated to the photosensitive material 14 to be thermally developed. The photosensitive material 14 to be thermally developed and conveyed to the thermally developing and transferring portion 62 with laminated to the image receiving material 72 is held and conveyed for $\frac{2}{3}$ round of the heating drum 64 between the heating drum 64 and the endless pressing belt 66 so that the same is subjected to the thermally developing and transferring process.

A separating claw 76 is disposed to the side portion of the thermally developing and transferring portion 62. This separating claw 76 is capable of separating the photosensitive material 14 to be thermally developed and the image receiving material 72 from the outer surface of the heating drum 64.

A separation portion 78 is disposed below the separation claw 76, this separation portion 78 being capable of separating the receiving material 72 from the photosensitive material 14 to be thermally developed and conveying it to the heater 82 with the receiving material 72 bent.

The thus-separated photosensitive material 14 to be thermally developed is conveyed to an waste photosensitive material accommodating box 80. On the other hand, the image receiving material 72 is conveyed to the upper surface of the taking-out tray 84 formed at the top portion of the frame 12 after it has been dried up by the heater 82.

Figure 2A:
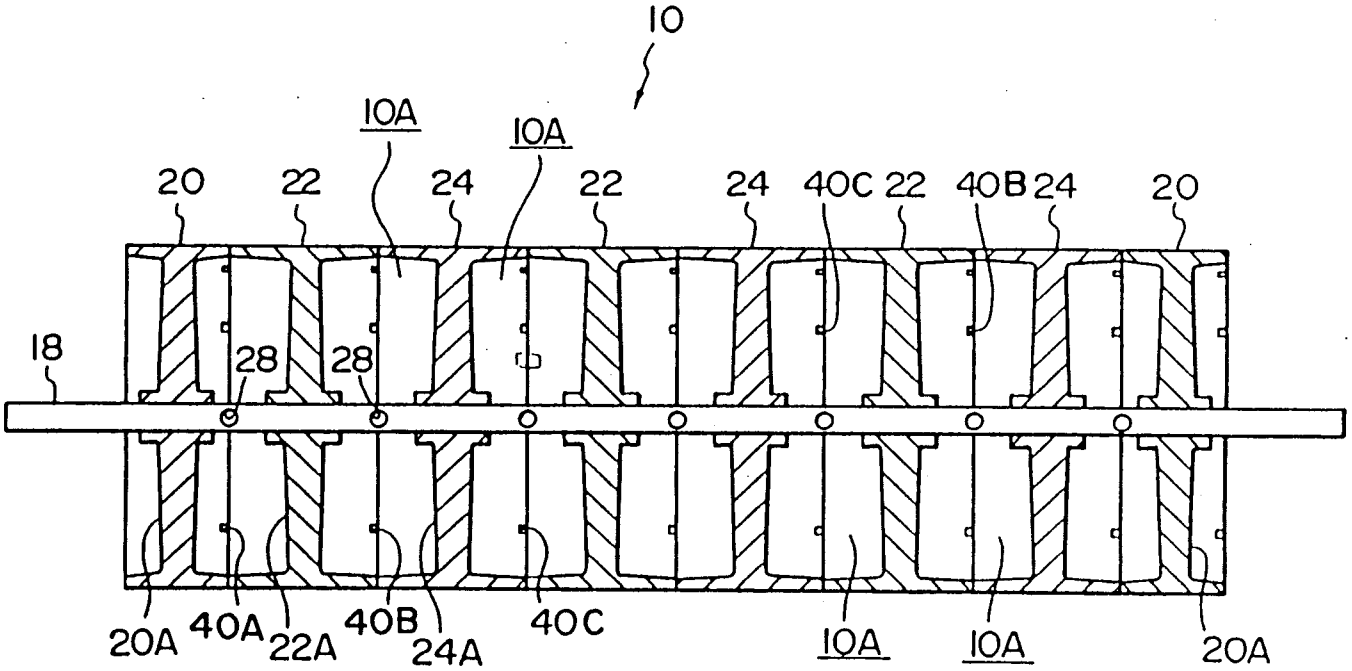
FIG. 2A is a cross-sectional view which illustrates the rotary drum.
Figure 2B:
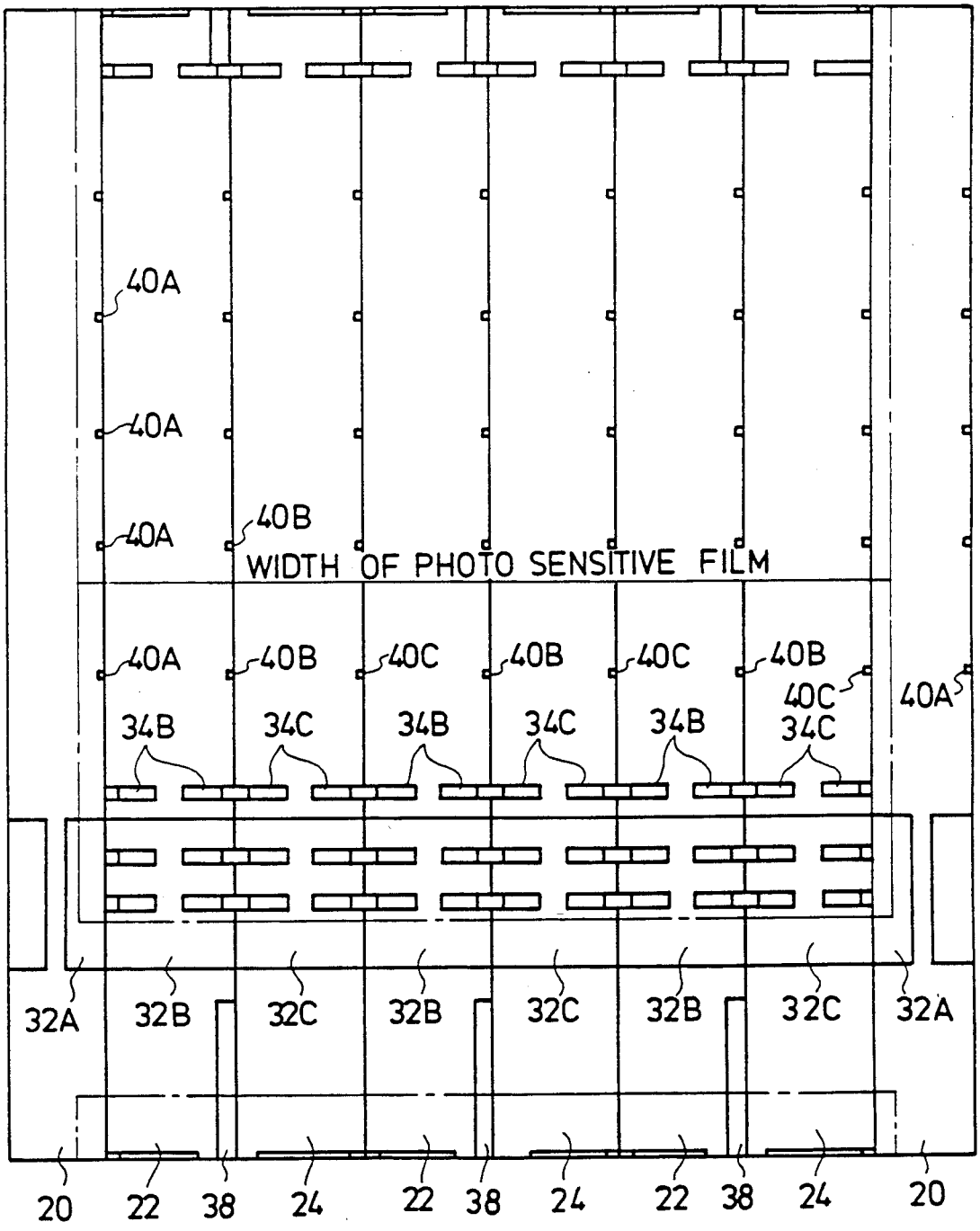
FIG. 2B is an extend elevation view of the rotary drum.

The rotary drum 10 comprises as shown in FIGS. 2A and 2B: a sole central shaft 18 serving as a shaft; a pair of side plates 20 to be secured to this central shaft 18; and a plurality of intermediate members 22 and 24 to be alternately disposed between the above-described side plates 20 and as well secured to the central shaft 18.

The central shaft 18 is formed in a hollow cylindrical shape in which a through hole 26 is formed from an end of the central shaft 18 to another end of the same, this central shaft 18 being manufactured by cutting a metal (for example, stainless steel) pipe into a predetermined length. A plurality of through holes 28 connected to the through hole 26 is axially formed in the outer surface of the central shaft 18 at predetermined intervals. This central shaft 18 is borne by the frame with a shaft, and is connected to a negative pressure source (omitted from illustration) so that air is sucked through the through holes 28. As the bearing, radial roller bearings shown in FIGS. 9 and 10 can be employed.

On the other hand, the side plates 20, and the intermediate members 22 and 24 are each manufactured by die-casting in which aluminum is used so as to be molded in a cylindrical shape. Ribs 20A, 22A, and 24A are formed on the inside of each of these materials. Through holes 30A, 30B, and 30C are formed in the corresponding ribs 20A, 22A, and 24A. The central shaft 18 is inserted into and secured to each of these through holes 30A, 30B, and 30C so that the thus-integrated components are rotated together.

Connecting portions 22B and 24B are formed in the corresponding ribs 22A and 24A of the intermediate members 22 and 24. Therefore, when each of the members are secured to the central shaft 18 so that they are brought into close contact with and integrated with one another, the space between the intermediate member 22 and the intermediate member 24 are connected to each other. However, a insulated chamber 10A is created by the rib 20A of the side plate 20.

Cutouts 32A, 32B, and 32C each of which is formed by cutting in parallel to the central shaft 18 are formed in a portion of the outer surface of each of the members. These cutouts form a series cutouts connecting on the outer surface of the rotary drum 10 when the members above are secured to the central shaft 18 and are integrated with each other.

Absorption grooves 34B and 34C whose longitudinal directions are arranged to be the axial direction of the central shaft 18 are formed in the vicinity of the portion in which the cutout 32B or the cutout 32C is formed in the intermediate members 22 and 24. However, the above-described grooves are not formed in the central portion in the axial direction of the intermediate members 22 and 24. These absorption grooves form a series and continuous absorption grooves when the above-described components are secured to the central shaft 18 and are integrated with one another.

Connection holes 36B and 36C serving openings for connecting the through hole 28 in the central shaft 18 to outside the drum via the chamber 10A are respectively formed at the end surfaces of the absorption grooves 34B and 34C. These connection holes 36B and 36C are formed when the molding is conducted.

A narrow separation groove 38 is formed in the circumferential direction of the intermediate member 22, this separation groove 38 being disposed on either one of the end surfaces of the intermediate member 22. When the recording material is scraped, the scraper 58 (see FIG. 4) is inserted into this separation groove 38 so that the recording material is scraped. A plurality of absorption holes 40B connecting the chamber 10A to the outside of the drum are formed in the other portion of the above-described end surface of the intermediate member 22, these absorption holes 40B being disposed at the same intervals in the circumferential direction. This absorption hole 40B is, similarly to the connection hole 36B, connected to the through hole 28 in the central shaft 18 via the chamber 10A. A plurality of absorption holes 40A and 40C, which are of similar to the absorption hole 40B, are formed in the side plates 20 and the intermediate members 24. The shape of these absorption holes 40A and 40C may be optionally selected from a group consisting of circle, square, ellipse and the like.

Figure 9:
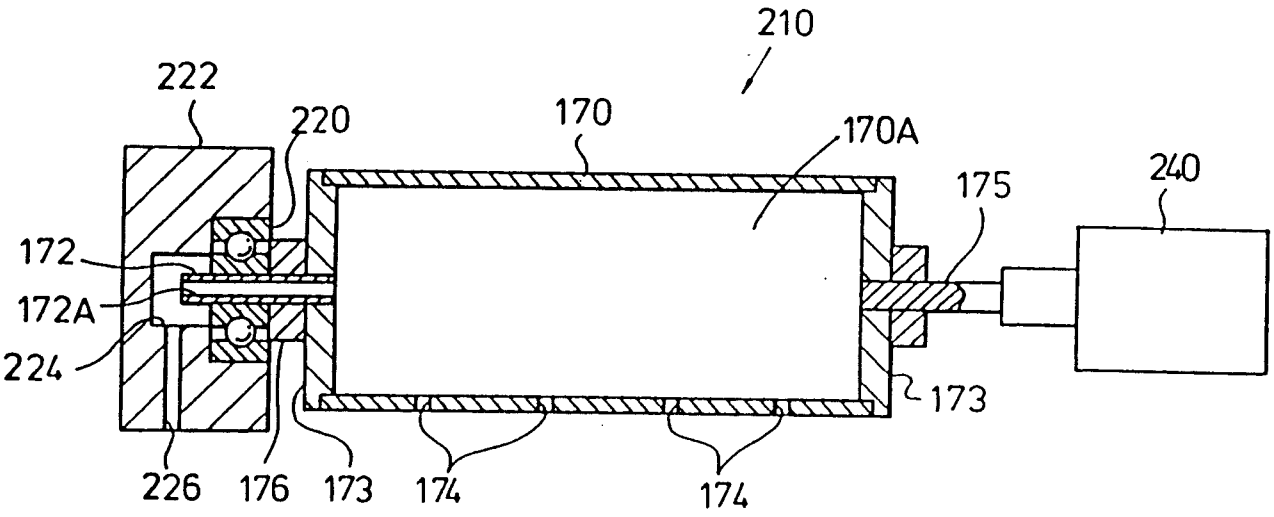
FIG. 9 is a schematic cross-sectional view which illustrates the overall body of a fourth embodiment of the rotary drum according to the present invention.

The rotary drum 10, formed by integrally securing the side plates 20 and the intermediate members 22, 24 to the central shaft 18, can be rotated at high speed (for example 1800 rpm) by a rotating force from a power source such as motor 240 shown in FIG. 9 or the like. During this rotation, air is sucked through the connection holes 36B and 36C and absorption holes 40A, 40B, and 40C connected to the through hole 28 so that the photosensitive material 14, to be thermally developed and wound to the outer surface of the rotary drum 10, is brought into close contact with the rotary drum 10.

Then, a method of manufacturing the rotary drum will be described.

Figure 3:
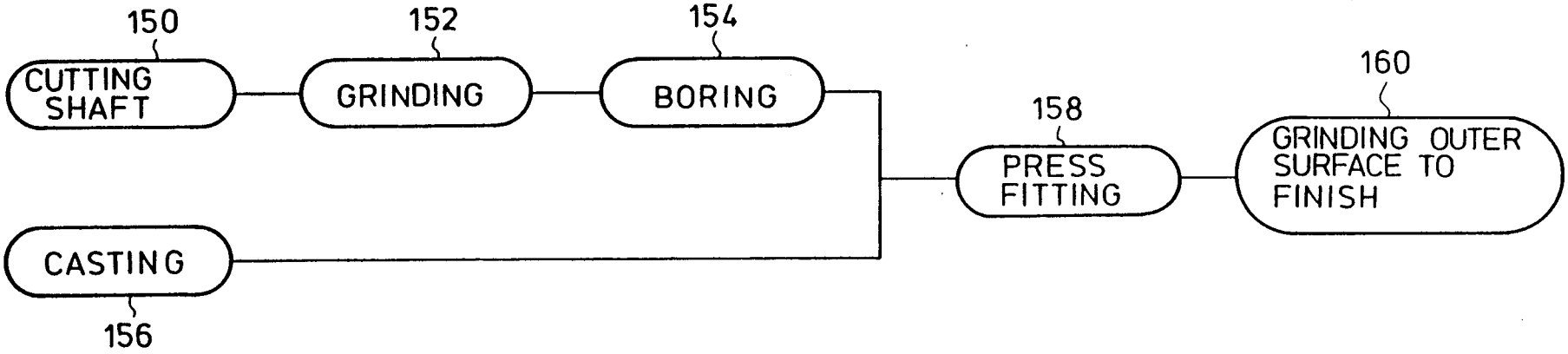
FIG. 3 is a flow chart for manufacturing the rotary drum.

As shown in FIG. 3, when the rotary drum 10 is manufactured, a metal (stainless steel) pipe is cut into a predetermined length in a cutting work 150 so that a central shaft 18 is obtained before being subjected to a grinding work 152 so as to make this central shaft 18 exhibit a predetermined manufacturing accuracy. Then, a plurality of through holes 28 are formed by a hole forming work 154.

On the other hand, the side plates 20, the intermediate members 22 and 24 are respectively molded in one process so as to be predetermined shapes in an aluminum die-casting process 156, that is, they are molded so that cutouts 32A, 32B, 32C, the absorption grooves 34B, and 34C, and connection holes 36B, 36C, the separation groove 38, and the absorption holes 40A, 40B, 40C are respectively formed.

Then, the side plates 20, the intermediate members 22 and 24 are press-fitted into the central shaft 18 so as to be integrated with one another. At this time, the side plates 20 need to be positioned at two ends of the central shaft 18 and the intermediate members 22 and 24 need to be alternately positioned between the side plates 20 disposed as described above. Then, the outer surface is made smooth by a grinding work 160 as the final finish work.

As described above, the rotary drum 10 can be manufactured from an excessively reduced number manufacturing processes. Furthermore, expensive manufacturing machines become no longer necessary, causing the required cost to be reduced. In addition, since the side plates 20, the intermediate members 22 and the intermediate members 24 are made by casting, uniform accuracy can be exhibited by the completed products. Therefore, skilled workers do not need to manufacture the products above uniformly. In addition, since the products above are manufactured by casting work, an improved freedom can be obtained in designing the shape of the products above, causing the design in which inertia force is intended to be reduced or design in which the dynamic balance is intended to be corrected can be readily conducted.

In this case, if a structure arranged such that positioning holes are formed in the side plates 20, the intermediate members 22, and the intermediate members 24, respectively, or a structure in which the components above are fitted to boss portions, is employed, deflection of the relative position of the above-described components can be prevented when they are secured to the central shaft 18.

A photosensitive material 14 to be thermally developed which has drawn out from the magazine 52 and cut by the cutter 54 is wound to the rotary drum 10 which has been manufactured as described above.

Furthermore, when air is sucked from the through hole 28 in the central shaft 18 by a negative pressure from a negative pressure source (omitted from illustration), air is absorbed through the connection holes 36B and 36C connected to the through hole 28 and the absorption holes 40A, 40B, and 40C so that the photosensitive material 14 to be thermally developed which has been wound to the outer surface of the rotary drum 10 is brought into close contact with the rotary drum 10.

When the absorption operation due to the negative pressure is completed, the photosensitive material 14 to be thermally developed is, by the reverse rotation (in the direction designated by an arrow B), scraped by the scraper 58 from the rotary drum 10, and is applied with water serving as the image forming solvent in the water applying portion 60 before being conveyed to the thermally developing and transferring portion 62.

On the other hand, the image receiving materials 72 in the tray 70 are successively taken out by the supply roller 74 so as to be conveyed to the thermally developing and transferring portion 62 with being in contact with the photosensitive material 14 to be thermally developed.

The photosensitive material 14 to be thermally developed and the image receiving material 72 which have been conveyed to the thermally developing and transferring portion 62 are, with being positioned in contact with each other, held and conveyed between the heating drum 64 heated at substantially 90° C. by the halogen lamp 68 and the endless belt 66 for a distance corresponding to the circumference of the heating drum 64 so that the thus-held and conveyed photosensitive material 14 to be thermally developed is developed and an image is transferred on the image receiving material 72.

After the transferring has been completed, the photosensitive material 14 to be thermally developed and the image receiving material 72 are separated from the heating drum 64, and then the photosensitive material 14 to be thermally developed and the image receiving material 72 are separated from each other by the separation portion 78. The thus-separated photosensitive material 14 to be thermally developed is sent to the waste photosensitive material accommodating box 80, while the image receiving material 72 is, via the heater 82, conveyed to the taking-out tray 84.

Then, a second embodiment of the present invention will be described. The same components as those according to the first embodiment are given the same reference numerals, and description about these components are omitted. In addition, the guide plate is omitted from illustration.

Figure 5:
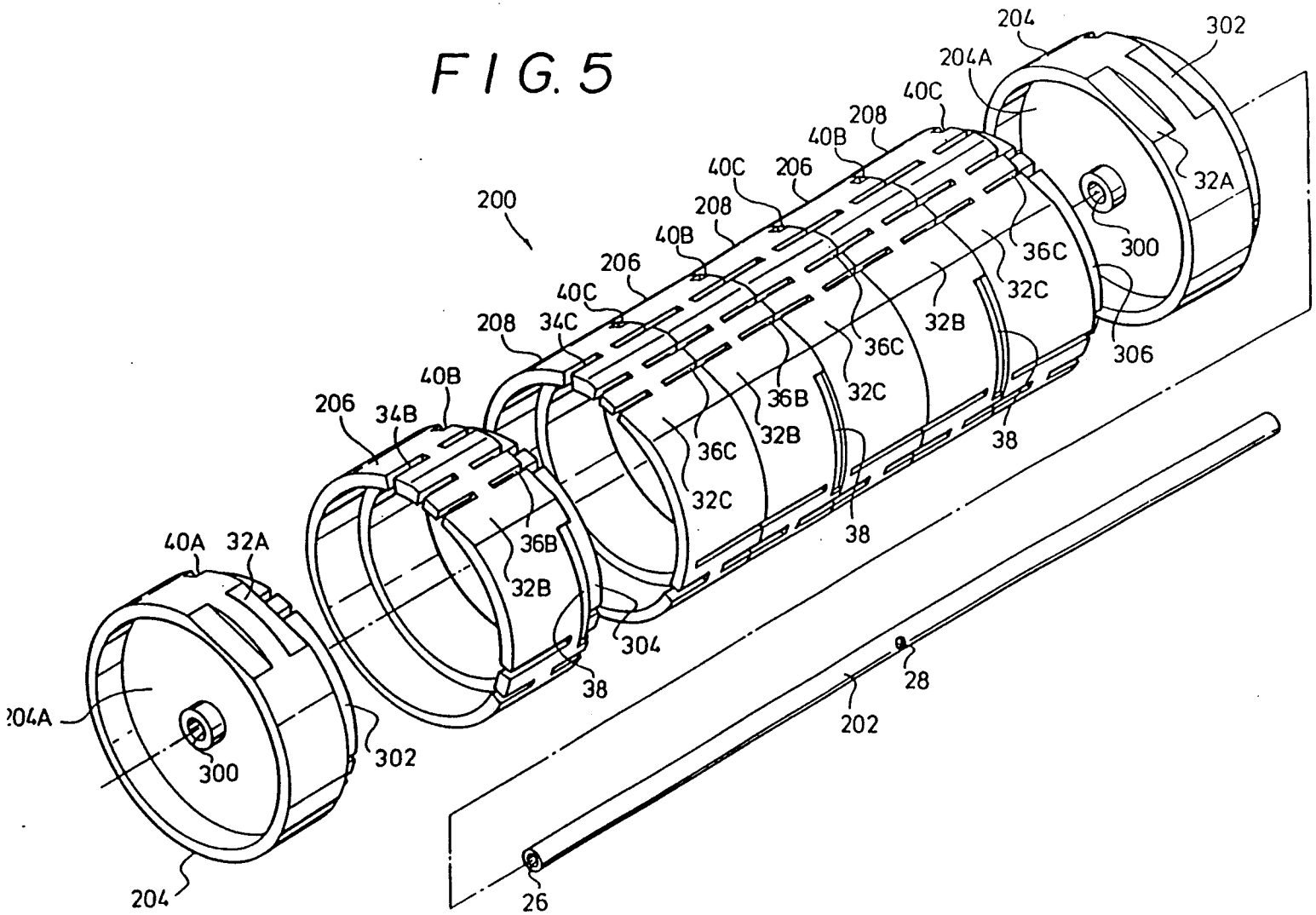
FIG. 5 is an exploded and perspective view which illustrates a second embodiment of the rotary drum according to the present invention.
Figure 6:
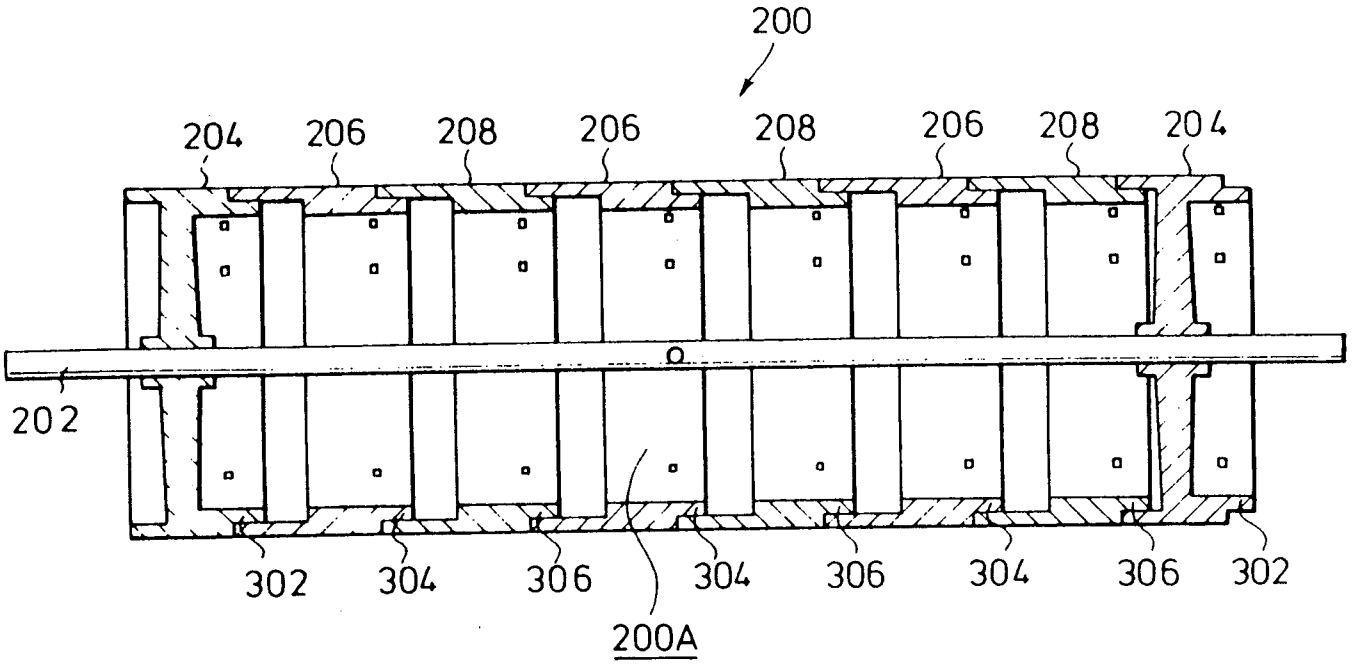
FIG. 6 is a cross-sectional view which illustrates the rotary drum.

As shown in FIGS. 5 and 6, a rotary drum 200 comprises: a sole central shaft 202 serving as a shaft; a pair of side plates 204 to be secured to this central shaft 202 and serving as the side members; and a plurality of intermediate members 206 and intermediate members 208 alternately disposed between these side plates 204 and serving as the main body as a result of being secured to the side plates 204 and secured to each other.

These side plates 204, the intermediate members 206, and the intermediate members 208 are manufactured by die-casting similarly to the first embodiment.

A rib 204A is formed on the side plates 204 similarly to the side plates 20 according to the first embodiment. A through hole 300 is formed in the central portion of the side plate 204 and the central shaft 202 is inserted into this through hole 300 so that the through hole 300 and the central shaft 202 are integrated with each other. A flange portion 302 serving as a fitting portion is formed on an edge of the side plate 204. This flange portion 302 is arranged to be fitted within the neighboring intermediate member 206 (or the intermediate member 208).

On the other hand, the difference from the first embodiment, no rib is formed in the cylindrical intermediate member 206 and the intermediate member 208 according to this embodiment. Flange portions 304 and 306 respectively serving as fitting portions are formed on each edge of the intermediate member 206 and the intermediate member 208. These flange portions 304 and 306 are arranged to be fitted within the neighboring intermediate member so that they are secured to and integrated with each other and a chamber 200A is formed. Therefore, the adherence of the conjunction portions between the side plates 204, the intermediate members 206, and the intermediate members 208 can be improved so that sucked air leakage which can be generated when air in the chamber 200A is sucked due to a negative pressure can be reduced so that a force necessary to drive the negative pressure source can be reduced.

According to the first embodiment, an improved dimensional accuracy is required between the through holes 30B and 30C and the outer surfaces of the intermediate members 22 and 24, these through holes 30B and 30C being formed in these intermediate members 22 and 24. However, since the intermediate members 206 and the intermediate members 208 are secured to each other alternatively to the structure in which they are secured to the central shaft 202, the outer surface of the drum can be readily smoothed, causing as well the accuracy thereof to be improved.

Furthermore, since the intermediate members 206 and the intermediate members 208 do not need to be assembled with press-fitted into the central shaft 202 and only the side plates 204 need to be press-fitted, the abrasion of the above-described members due to being subjected to repetition of the press-fittings can be reduced. In other words, they can be assembled by a tight fitting.

According to the above-described embodiments, the side plates 20, the intermediate members 22, and the intermediate members 24, or the intermediate members 204, the intermediate members 206, and the intermediate members 208 are cast products manufactured by die-casting. However, the present invention is not limited to the manufacturing method above. The above-described components may comprise moldings manufactured by injection molding a plastic material.

According to the embodiments above, although the central shaft 18 or the central shaft 202 is made of a pipe material having the surface thereof in which the through holes 28 are formed, these shafts may be structured, as an alternative to the pipe structure, in such a manner that a hole is bored from each end surfaces of the shafts and at least a through hole which connects the surface of the shaft is formed.

As described above, the rotary drum according to this embodiment can be manufactured from a reduced number of the manufacturing processes, causing the required cost to be reduced. Furthermore, an improved freedom in designing the shape can be exhibited, and a design in which the inertia force is intended to be reduced or a design in which the dynamic balance is intended to be corrected can be readily conducted.

Figure 7:
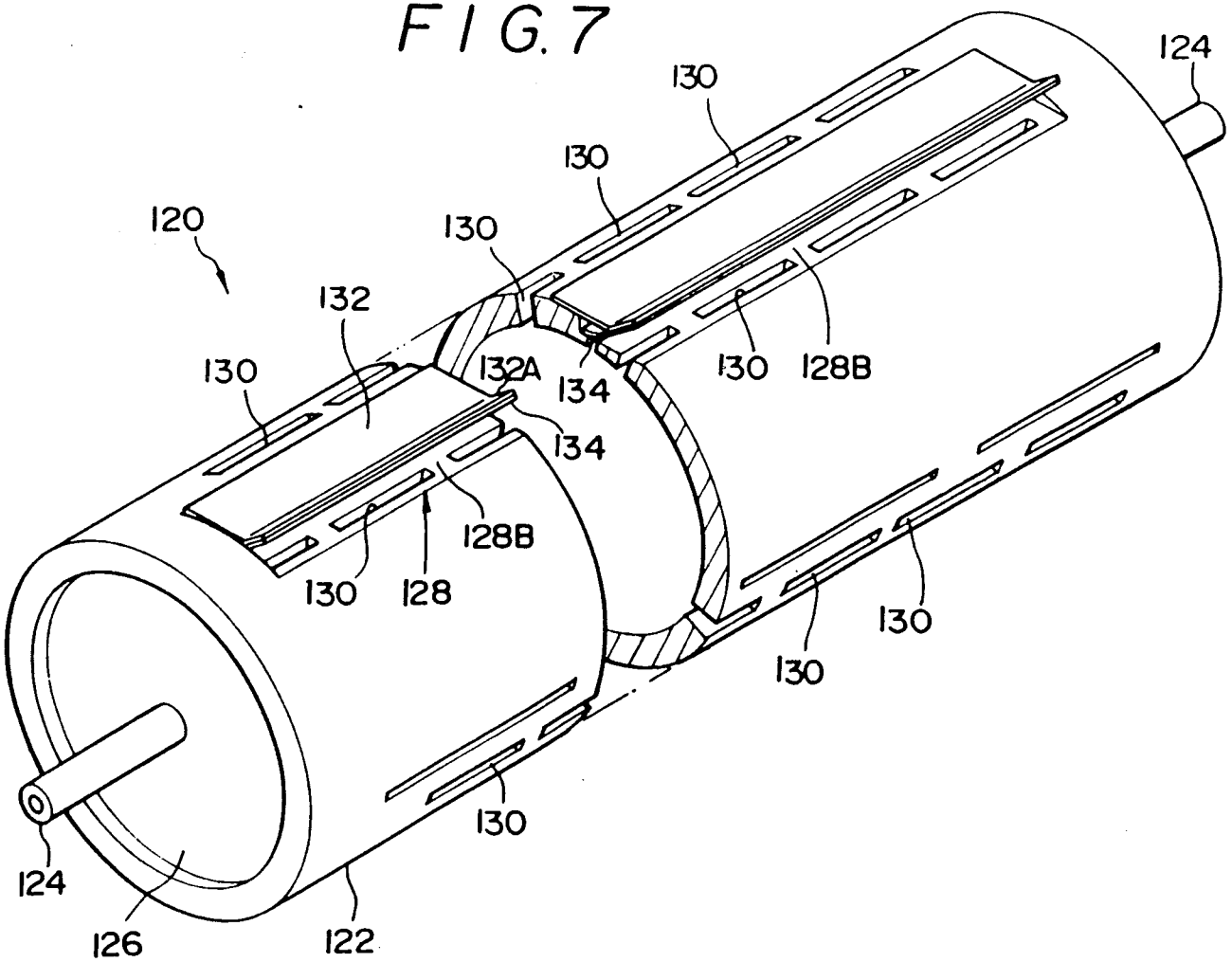
FIG. 7 is a perspective view which illustrates a third embodiment of the rotary drum according to the present invention.

Then, a third embodiment according to the present invention will be described. A rotary drum 120 according to this embodiment is, as shown in FIG. 7, formed such that the two ends of a cylindrical main body 122 are closed by side plates 124 and a hollow shaft 126 is secured to each central portion of the side plates 126.

Figure 8:
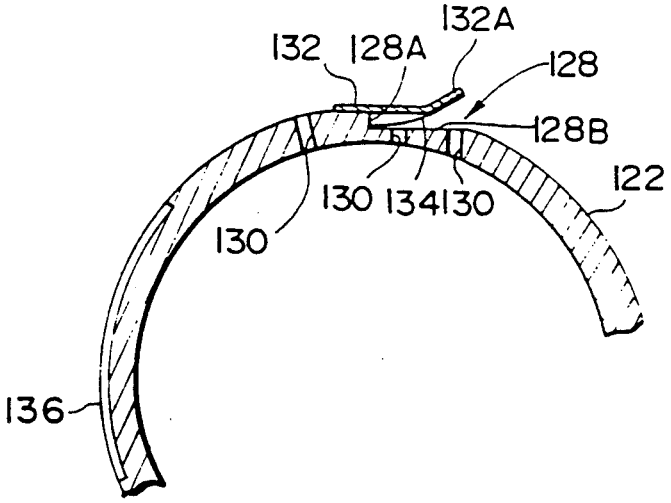
FIG. 8 is a cross-sectional view which illustrates the rotary drum.

An wedge shaped cutout 128 is, as shown in FIG. 8 in detail, formed in a portion of the outer surface of the main body 122. The depth of the cutout 128 (the dimension of a wall 182A) is arranged to be considerably larger than the thickness of the photosensitive material. A plurality of absorption holes 130 are formed to open in the outer surface of the main body 122, these absorption holes 130 being also formed in a bottom 128B of the cutout 128.

On the other hand, the shaft 124 is borne by a frame, and is as well connected to a negative pressure source (omitted from illustration) so that air is sucked through the absorption holes 130. The photosensitive material is wound to the rotary drum 120 by absorbing the photosensitive material to the absorption holes 130 by a negative pressure generated by sucking, via the shaft 134, air in the main body 122. An end of a guide plate 132 serving as the guide member is secured to the outer surface of the main body 122 connected to the wall 128A of the cutout 128. The guide plate 132 is disposed just above the cutout 128 such that it covers the cutout 128 and the end portion thereof is formed in a guide portion 132A bent in the direction away from the main body 122. The photosensitive material supplied along the outer surface of the main body 122 can be guided to the cutout 128 by this guide portion 132A.

An inserter 134 serving as the pressing member is secured to the guide portion 132A of the guide plate 132. This inserter 134 is made of a polyester film exhibiting elasticity realized due to its reduced thickness (it is arranged to be substantially 100 $\mu$ according to this embodiment) and is so disposed so as to project in the cutout 128, this inserter 134 being positioned in contact with the bottom 128B of the cutout 128. As a result, the front portion of the photosensitive material guided into the cutout 128 by the guide portion 132A of the guide plate 132 is pressed by the inserter 134 above so that this photosensitive material is held with positioned in close contact with the bottom 128B of the cutout 128. Therefore, any leakage of air can be prevented when the end portion of the photosensitive material is, via the absorption hole 130, absorbed by a negative pressure generated by absorbing air in the main body 122 via the shaft 124.

As shown in FIG. 8, a plurality of separation grooves 136, which are arranged so as to extend in the circumferential direction, are formed in a portion of the outer surface of the main body 122 in the vicinity of the cutout 128. The separation grooves 136 respectively have a narrow width and are formed at equal intervals in the axial direction so that the scraper 58 (see FIG. 4) is inserted through the separation grooves 136 when the photosensitive material is scraped.

This rotary drum 120 is disposed at the position corresponding to the position of the rotary drum 10 shown in FIG. 4 and is capable of rotating at high speed (for example 1800 rpm) by a rotating force from a rotating device (omitted from illustration).

When the photosensitive material is wound to the outer surface of the rotary drum 120, the front portion of the photosensitive material is held with positioned in close contact with the bottom 128B of the cutout 128 and air is sucked through the absorption holes 130 with the rotary drum 120 rotated in the direction designated by an arrow A shown in FIG. 4. As a result, the photosensitive material is wound to the rotary drum 120 and successively positioned in close contact with the outer surface.

Then, the operation of this embodiment will be described.

The rotary drum 120 is stopped with the cutout 128 thereof previously positioned to correspond to the supply roller 19.

The photosensitive material 14 obtained by cutting, with the cutter 54, the photosensitive material drawn out from the magazine 52 is supplied along the outer surface of the main body 122 by the supply roller 19.

The thus-supplied photosensitive material 14 is guided into the cutout 128 by the guide portion 132A of the guide plate 132, and the front portion of this photosensitive material 14 is pressed by the inserter 134 so that the photosensitive material 14 is held there with positioned in close contact with the bottom 128B of the cutout 128. In this state, air is sucked through the absorption holes 30 with the rotary drum 120 rotated in the direction designated by an arrow A shown in FIG. 4 so that the photosensitive materials 14 is wound to the outer surface of the rotary drum 120 with successively brought into close contact with the outer surface of the main body 122.

In this case, since the front portion of the photosensitive material 14 is held with pressed by the inserter 134 and positioned in close contact with the bottom 128B of the cutout 128, any air leakage which can be generated when a negative pressure is generated by sucking air through the absorption holes 130 in the cutout 128 can be prevented if curl or a turn is present at the front portion of the photosensitive material 14. If the front portion of the photosensitive material 14 is brought into contact with the wall portion 128A of the cutout 128 due to an excessive movement of the photosensitive material 14, the front portion of this photosensitive material 14 is protected from buckling in the cutout 128. Therefore, the absorbing performance can be improved and the photosensitive material 14 can be assuredly and stably absorbed and wound to the rotary drum 120.

Furthermore, the absorption of the photosensitive material 14 can be completed regardless of the front shape of the photosensitive material 14 formed by cutting or regardless of the position alignment. In addition, the moving of the photosensitive material 14 does not need to be accurately controlled, causing the cost to be reduced.

When the absorption by using the negative pressure is completed, the shaft 124 is rotated at high speed in the direction designated by an arrow A by a rotating means (omitted from illustration) and the exposure head 56 is moved in the axial direction of the rotary drum 120 so that an image is scanned and exposed to the photosensitive material 14.

When the exposure is completed, the rotary drum 120 is stopped at a position at which the separation groove 136 of the main body 122 corresponds to the scraper 58. In this state, the scraper 58 is inserted into the separation groove 36.

When the rotary drum 120 is then rotated in the direction designated by an arrow B shown in FIG. 4, the photosensitive material 14 is separated by this scraper 58 from the outer surface of the rotary drum 120, and is conveyed to the water applying portion 60.

Then, the thermal developing and transference is conducted similarly to the first embodiment.

As described above, the rotary drum according to this embodiment is structured such that the openings for absorbing the recording material are formed on the outer surface thereof and a guide member for guiding the front portion of the recording material is provided therein so that the recording material guided to this outer surface is wound thereto by absorbing the same through the openings. Since the rotary drum according to this embodiment comprises a pressing member for pressing and retaining the front portion of the recording member guided by the guide member to the outer surface, the recording material can be assuredly and stable absorbed and wound to the outer surface with the required cost reduced.

Then, a fourth embodiment according to the present invention will be described in detail.

As shown in FIG. 9, the rotary drum 210 comprises: a cylindrical main body 170; and hollow shafts 172 and 175 secured to the side plate 173 thereof. The main body 170 may comprise the main body according to the second embodiment. A through hole 172A is axially formed in the shaft 172, and a spacer 176 is secured to a portion of the outer surface of the shaft 172. An absorption hole 174 is formed on the outer surface of the main body 170.

Figure 10:
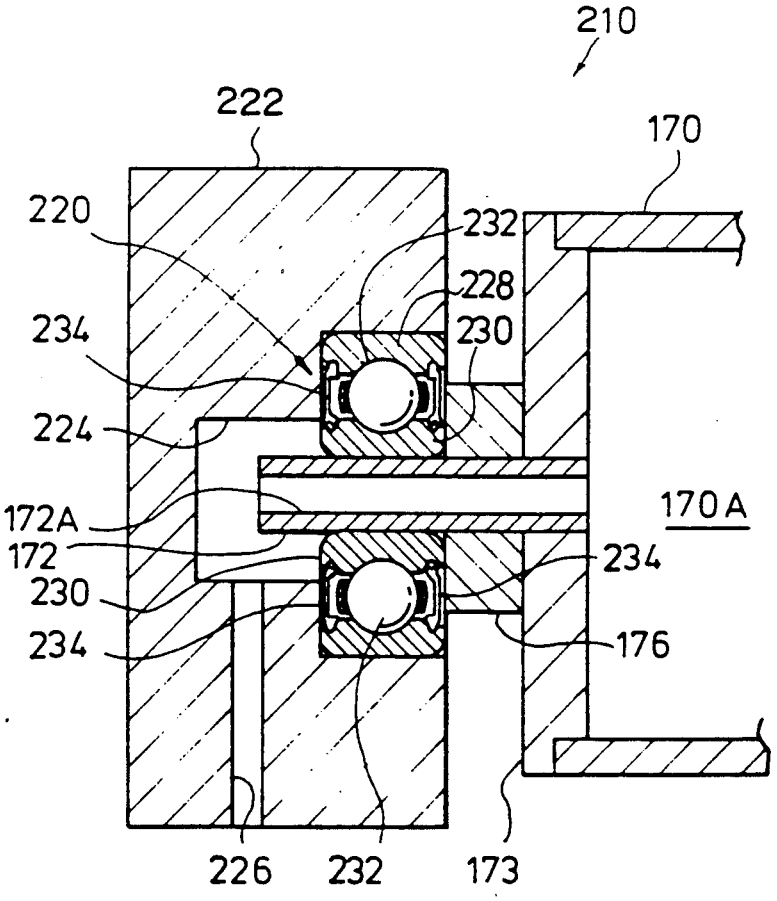
FIGS. 10 and 11 are enlarged views which illustrate essential portions shown in FIG. 9.

The shaft 172 of this rotary drum 210 is supported, with a bearing 220, within a support hole 224 formed in a housing 222. A connection hole 226 is connected to a portion of this support hole 224, this connection hole 226 being connected to a negative pressure source (omitted from illustration). Therefore, when this negative pressure source is operated, air in a chamber 170A formed in the main body 170 is sucked via the through hole 172A in the shaft 172 so that a negative pressure is generated. As shown in FIG. 10, the bearing 220 comprises a ball bearing consisting of an outer race 228, an inner race 230, and balls 232. The outer race 228 is press-fitted into the support hole 224 in the housing 222, while the shaft 172 of the rotary drum 210 is press-fitted into the inner race 230, so that the rotary drum 210 is rotatably supported. In this case, the spacer 176 secured to a portion of the outer surface of the shaft 172 is positioned in contact with the inner race 230.

The outer surface of a seal lip 234 having a flat annular shape, that is, a shape closed in the circumferential direction, is secured to the two sides of the outer race 228. The seal lip 234 is manufactured by laminating synthetic rubber to a steel plate so as to have a proper elasticity.

Figure 11:
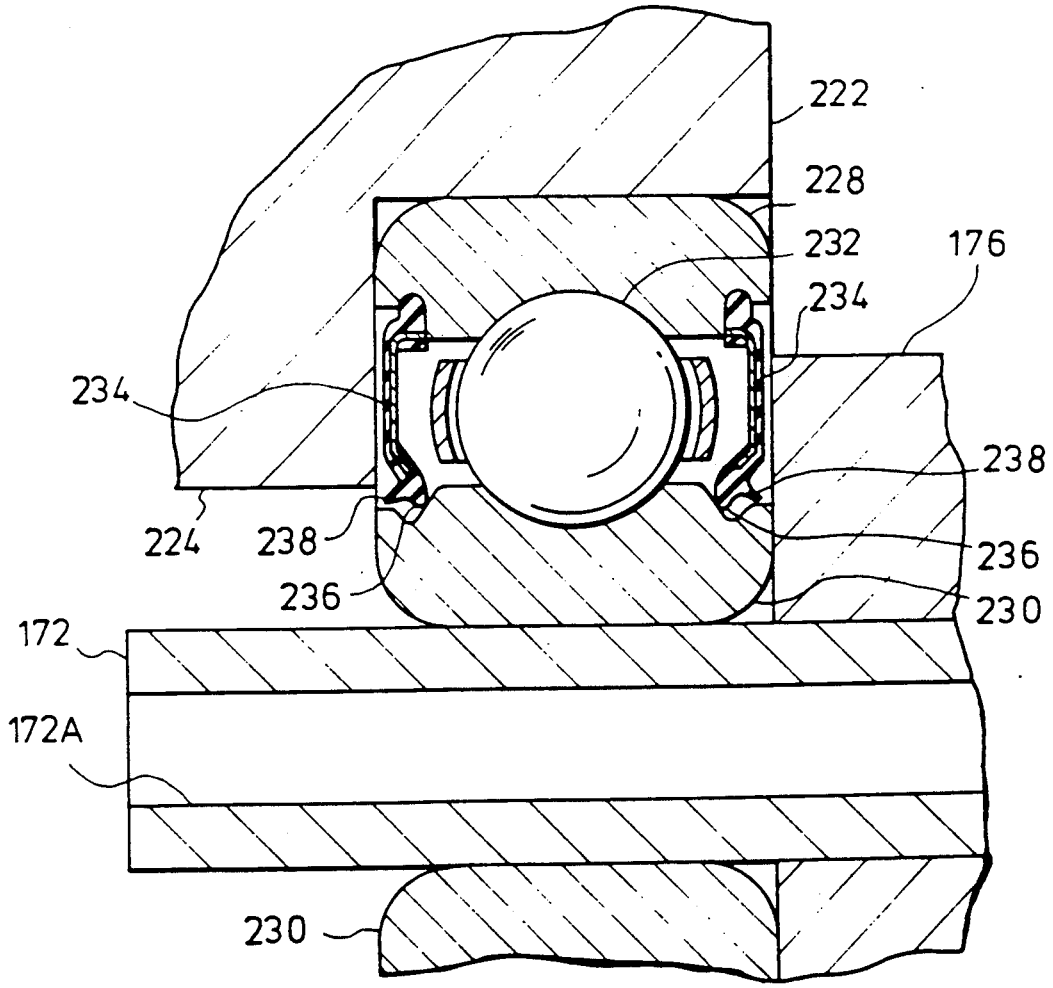
Figure 12:
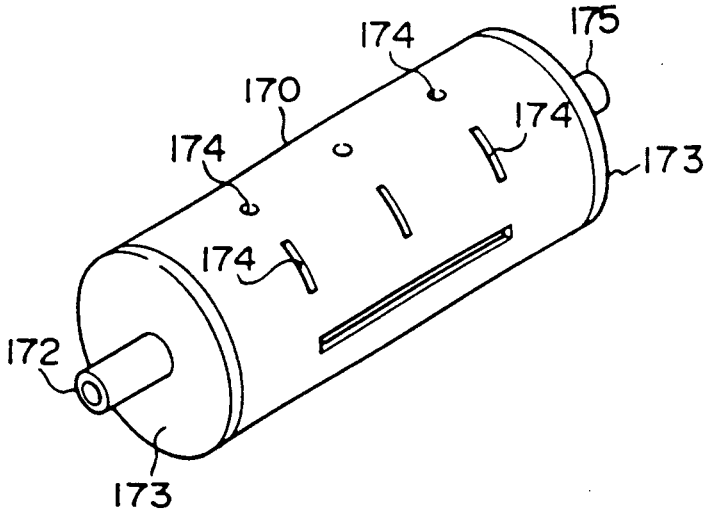
PRIOR ART FIG.12
FIG. 12 is a perspective view which illustrates a conventional rotary drum.
Figure 13:
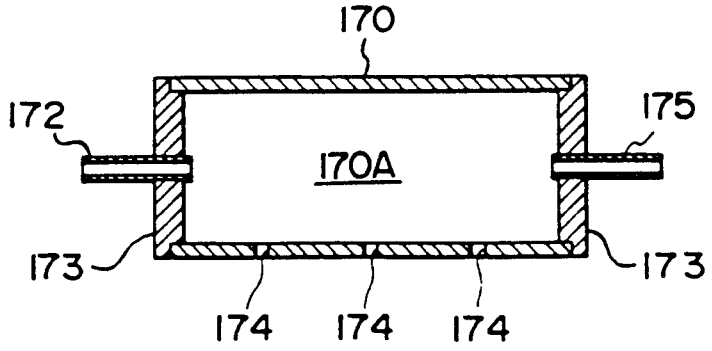
PRIOR ART FIG.13
FIG. 13 is a cross-sectional view which illustrates the rotary drum shown in FIG. 12.
Figure 14:
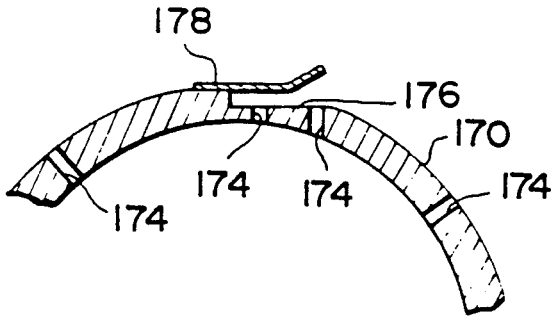
PRIOR ART FIG. 14
FIG. 14 is a cross-sectional view which illustrates a guide plate portion of the conventional drum.
Figure 15:
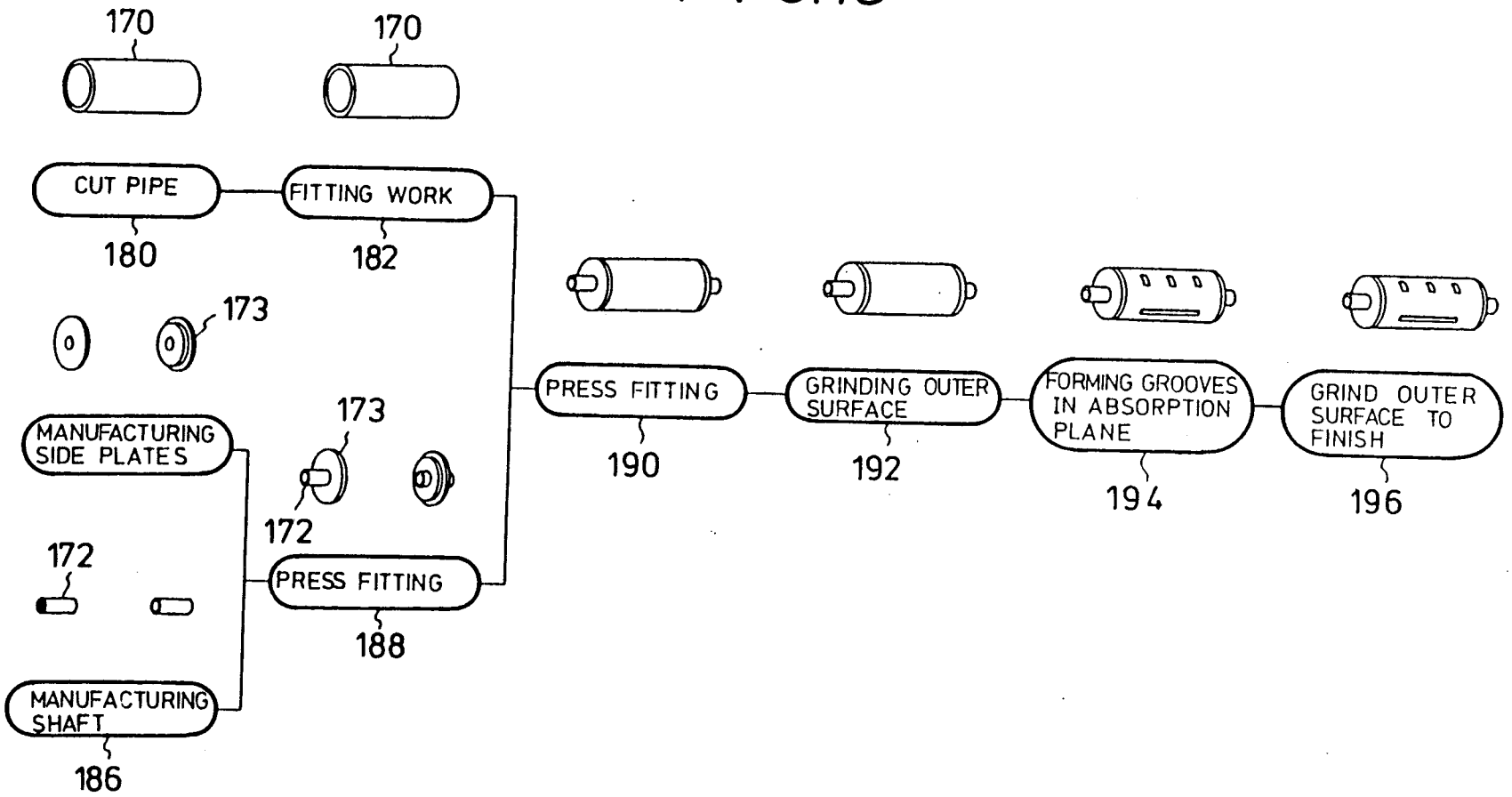
PRIOR ART FIG. 15
FIG. 15 is a flow chart for manufacturing the conventional rotary drum.

As shown in FIG. 11, an inner lip 236 and an outer lip 238 are integrally formed on the inside of the seal lip 234. The inner lip 236 is positioned in contact with the inner race 230 so that an sealing effect is generated and thereby air or dust invasion into the bearing 220 (the portion in which the ball 232 is disposed) is prevented. On the other hand, the outer lip 238 forms a small gap from the inner race 230 so that the labyrinth effect is generated. If the inner lip 236 is worn, this outer lip 238 is arranged to be brought into contact with the inner race 230 so that the sealing effect can be kept for a long time. Furthermore, since the seal lip 234 positioned adjacent of the support hole 224 is close by the side wall of the support hole 224, while the seal lip 234 disposed adjacent to the rotary drum 210 is close by the spacer 176 secured to the shaft 172, a further improved sealing performance can be obtained.

As a result, the space between the inner race 230 and the outer race 228 is sealed up by the seal lip 234 so that air invasion in the support hole 224 in the housing 222 through the bearing 220 can be prevented.

On the other hand, the shaft 175 of the rotary drum 210 is connected to the motor 240 serving as the rotation power source so that the rotary drum 210 is rotated relative to the axis thereof. Therefore, the shaft 175 is rotated by rotating the motor 240 and simultaneously the negative pressure source is operated so that air in the negative pressure chamber 170A formed in the main body 170 is sucked via the through hole 172A in the shaft 172 and a negative pressure is generated. As a result, the photosensitive material to be thermally developed can be brought into close contact with the absorption hole 174, that is, the outer surface of the main body 170.

Alternatively, a structure may be employed which is arranged such that the inner surface of the seal lip is secured to the inner race and an inner lip and an outer lip may be formed on the outer surface of the seal lip.

This rotary drum 210 is mounted on the place at the same position as that for the rotary drum shown in FIG. 4.

In this case, the shaft 172 of the rotary drum 210 is borne by the bearing 220 and the seal lip 234 in which the inner lip 236 and the outer lip 238 are formed at the front portion thereof is secured to the bearing 220. The inner lip 236 of the seam lip 234 is positioned in contact with the inner race 230 so that a sealing effect is generated. As a result, the dust or air invasion into the bearing 220 (in the portion in which the ball 232 is positioned) can be prevented. In addition, a small gap is formed between the outer lip 238 and the inner race 230 so that the labyrinth effect is generated. As a result, the space between the inner race 230 of the bearing 220 and the outer race 228 of the same is sealed up by the seal lip 234 so that air invasion into the support hole 224 in the housing 222 via the bearing 220 is prevented. The seal lip 234 positioned adjacent to the support hole 224 is close by the side wall of the support hole 224, while the seal lip 234 positioned adjacent to the rotary drum 210 is in close by the spacer secured to the shaft 172 so that a further improved sealing performance is obtained.

Therefore, when air is subjected with the shaft 172 secured to the inner race 230 rotated, leakage of sucked air through the portion for bearing the rotation of the shaft 172 can be prevented.

The photosensitive material 14 to be thermally developed is, after being subjected to the exposure, separated from the rotary drum 210 by a scraper 58 due to the reverse rotation (in the direction designated by an arrow B shown in FIG. 4), and is applied with water serving as a image forming solvent in the water applying portion 60 before being conveyed to the thermally developing and transferring portion 62.

As a result, the thermally developing and transferring is, as described above, conducted.

As described above and according to the present invention, leakage of sucked air through the portion of the shaft 172 for bearing the rotation of the rotary drum 210 can be prevented if air is sucked with the rotary drum 210 rotated. In addition, since a simple structure is employed in which the shaft 172 is supported to the housing 222 by the bearing 220, any adjustment does not need to be conducted at assembling the components, causing satisfactory manufacturing yield to be obtained.

The structure is employed according to this embodiment arranged such that the inner lip 236 formed at the front portion of the seal lip 234 is brought into contact with the inner race 230. However, the present invention is not limited to the structure above, another structure may be employed which is arranged in such a manner that both the inner lip 236 and the outer lip 238 form small gaps from the inner race 230. In this case, a further improved labyrinth effect can be obtained between each of the lips and the inner race 230. Furthermore, an involved friction resistance can be reduced due to its non-contact structure, force needed to rotate the rotary drum 210 can be reduced.

According to this embodiment, a structure is employed which is arranged in such a manner that the bearing 20 is press-fitted in the housing 222 and the shaft 172 is press-fitted in the shaft 220. The present invention is not limited to this structure. A structure may be employed in which the above components are secured by using an adhesive. Furthermore, an "O" ring may be positioned between the housing 222 and the outer race 228 and between the shaft 172 and the inner race 230. As a result, a further improved sealing performance can be obtained.

As described above, the rotary drum according to this embodiment is arranged in such a manner that its shaft in which the through hole for sucking air is axially formed is rotated relatively to the axis with being borne by the radial roller bearing. This radial roller bearing comprises a pair of seal lip whose outer surface is secured to either of the side portions of the outer race or the inner race. Therefore, any sucked air leakage can be prevented when inner air is sucked through the shaft rotatably supported. Furthermore, this effect can be realized by a simple structure exhibiting a satisfactory manufacturing yield only with a reduced cost.

What is claimed is:

1. A drum for an image recording apparatus comprising:

a main body member comprising a plurality of separate cylindrical members, each comprising an outer surface and two end surfaces separated in an axial direction, said cylindrical members being arranged serially in said axial direction, each of said cylindrical members having a plurality of openings in opposite end surfaces thereof for attracting a recording material against a surface wall constituted by said outer surfaces of said cylindrical members;

a pair of side members for closing two sides of said main body member and forming a chamber internal of said surface wall, wherein said side members also are cylindrical and also are arranged in said axial direction; and a shaft member arranged to penetrate said main body and said pair of side members, so as to be disposed internal of said surface wall and to be secured to at least said pair of side members, in which a through hole establishing a connection between said chamber and outside is formed therein.

2. A drum for an image recording apparatus according to claim 1, wherein said main body is structured in such a manner that a fitting portion is formed on an inner surface of each of said plurality of cylindrical members so as to secure said fitting portions to said shaft member.

3. A drum for an image recording apparatus according to claim 1, wherein said main body is structured in such a manner that a fitting portion is formed on an inner surface of each of said plurality of cylindrical members so as to secure said fitting portions to neighboring ones of said plurality of cylindrical members.

4. A drum for an image recording apparatus according to claim 2, wherein said fitting portion is a flange portion arranged to be fitted within a neighboring one of said plurality of cylindrical members.

5. A drum for an image recording apparatus according to claim 1, wherein said plurality of openings form narrow groves in said surface wall in an axial direction.

6. A drum for an image recording apparatus according to claim 1, wherein at least one of said plurality of cylindrical members forms a separation groove with a neighboring one of said cylindrical members, whereby a scraper may be inserted in said groove so that said recording material may be scraped of said drum.

7. A drum for an image recording apparatus according to claim 1, wherein each of said plurality of cylindrical members has a planar portion that forms a series of cutouts on said surface wall when said cylindrical members are integrated to form said main body member.

8. A drum for an image recording apparatus according to claim 1, wherein said openings are axially extending slots, and wherein said slots in the end surfaces of neighboring cylindrical members being in axial alignment with each other.

* * * * *